US008073180B2

(12) United States Patent
Bruckhoff

(10) Patent No.: US 8,073,180 B2
(45) **Date of Patent: *Dec. 6, 2011**

(54) HEADSET FOR A FUNCTIONAL DEVICE

(75) Inventor: Henning Bruckhoff, Garbsen (DE)

(73) Assignee: Bruckhoff Apparatebau GmbH, Hannover (DE)

( * ) Notice: Subject to any disclaimer, the term of this patent is extended or adjusted under 35 U.S.C. 154(b) by 1112 days.

This patent is subject to a terminal disclaimer.

(21) Appl. No.: 11/826,774

(22) Filed: Jul. 18, 2007

(65) Prior Publication Data

US 2007/0264850 A1 Nov. 15, 2007

Related U.S. Application Data

(63) Continuation of application No. PCT/DE2006/000063, filed on Jan. 18, 2006.

(30) Foreign Application Priority Data

Jan. 18, 2005 (DE) ..... 10 2005 002 482
May 3, 2005 (DE) ..... 10 2005 021 012
Nov. 21, 2005 (DE) ..... 10 2005 055 762

(51) Int. Cl.
*H04R 25/00* (2006.01)

(52) U.S. Cl. ..... 381/381; 381/374

(58) Field of Classification Search ..... 381/374, 381/375, 381; 379/430

See application file for complete search history.

(56) References Cited

U.S. PATENT DOCUMENTS 2,418,120 A 4/1947 Hornickel
4,039,765 A 8/1977 Tichy et al.
4,289,938 A * 9/1981 Zichy ..... 381/381
6,097,827 A * 8/2000 Yang ..... 381/375
6,233,344 B1 5/2001 Clegg
6,396,935 B1 5/2002 Makkonen
6,625,293 B1 9/2003 Nageno et al.

FOREIGN PATENT DOCUMENTS

DE 101 39 865 A1 4/2003

(Continued)

OTHER PUBLICATIONS

Patent Abstracts of Japan, publication No. 58 136199 to Ikeda Yasuo, publication date Aug. 13, 1983, titled "Single Ear Transmission and Reception Type Earphone" (1 page).

(Continued)

*Primary Examiner* — Brian Ensey
(74) *Attorney, Agent, or Firm* — Shlesinger, Arkwright & Garvey LLP

(57) ABSTRACT

Headset includes a signal interface configured for receiving and forwarding electrical signals, a bending-resistant, bendable retaining member, and a functional device attached to the retaining member. Retaining member being bendable and held in a bent position without a restoring force, and is connected to signal interface for positioning functional device. Electrical signal lines provided in retaining member, and running between signal interface and functional device. Fixing element which can be placed on retaining member in various longitudinal positions to secure retaining member. Retaining clip, which can be bent into position, extends between signal interface and fixing element; and. Rear section of retaining member, signal interface, retaining clip, fixing element form a loop, the size of loop being adjustable and changeable by displacing fixing element along retaining member, in use, and loop being configured for receiving an auricle of a user and running at least partially behind auricle, is use.

24 Claims, 4 Drawing Sheets

FOREIGN PATENT DOCUMENTS

| | | | | |
|---|---|---|---|---|
| DE | 10139865 | A1 | * | 4/2003 |
| DE | 10 2005 021 012 | A1 | | 11/2006 |
| GB | 2 036 505 | A | | 6/1980 |

OTHER PUBLICATIONS

PCT International Search Report dated Jun. 23, 2006 in PCT application No. PCT/DE2006/000063, filed Jan. 18, 2006 (4 pp.).

PCT Schriftlicher Bescheid der Internationalen Recherchenbehorde (rEGEL 43*bis*.1 PCT) filed in PCT application No. PCT/DE2006/000063, filed Jan. 18, 2006 (6 pp.).

German Office Action dated Dec. 11, 2007, in priority application No. 10 2005 055 762.7, 2 pages.

English Abstract of German Patent document No. DE 101 39 865 A1, publication date Mar. 4, 2003 to Siemens AG, 1 page.

* cited by examiner

HEADSET FOR A FUNCTIONAL DEVICE

CROSS-REFERENCE TO RELATED APPLICATIONS

This application is a continuation of application no. PCT/DE2006/000063, filed Jan. 18, 2006, which claims the priority of German application no. 10 2005 055 762.7, filed Nov. 21, 2005, and which claims the priority of German application no. 10 2005 021 012.0, filed May 3, 2005, and which claims the priority of German application no. 10 2005 002 482.3, filed Jan. 18, 2005, and each of which is incorporated herein by reference.

FIELD OF THE INVENTION

The invention relates to a headset for a functional device, particularly a microphone.

BACKGROUND OF THE INVENTION

Headsets are used particularly for fastening microphones to the head of the user. In this way, voice input by the user into the microphone can be performed without the user having to hold the microphone by his hands.

Headsets of this type typically include—similar to headphones—a clip that is placed over the head, the clip due to its elasticity tensioning and securing the headset against the head. They can be used, for example, by singers during live appearances or by task force members, for example the police, for communication purposes.

Headsets of this type, however, are expensive, bulky, and at times impair audio reception. Furthermore, they interfere with the visual appearance of the person and interfere with additional head gear the user may be wearing.

Locking a functional device in place to the outer ear by means of slings, suspension clips or the like in general does not guarantee stable, slip-free fastening, whereby the functional device can be positioned starting from the outer ear, for example, as a microphone in the mouth region of the user.

DE 102 27 450 B4 shows a headset for a functional device, particularly a microphone, wherein an insert body is inserted in the concha or auditory canal of the user and held by a retaining clip, which is braced against the concha. On the insert body, a holding device is provided, which carries the attached functional device, for example a rigid wire clip.

Headsets are furthermore used in the medical field to attach transmitters for cochlea implants. These headsets may include a bending element and an otoplasty element to be inserted in the patient's ear, as is described in DE 201 05 562 U1, for example.

U.S. Pat. No. 6,396,935 B1 shows a headset with a rigid, bendable retaining member, and at the ends of which a microphone and a speaker are provided. The retaining member is placed around the auricle of the user and on the inside includes a transceiver for reciprocal communication with a device, which is carried in the shirt pocket, for example.

OBJECTS AND SUMMARY OF THE INVENTION

An object of the invention is to overcome the drawbacks of the prior art.

Another object of the invention to create a headset, which guarantees secure positioning of a functional device in the head region of the user, and which is nevertheless small in size, and, to a great extent, is not considered to be interfering.

This object is achieved according to the invention with a headset which includes a signal interface configured for receiving and forwarding electrical signals, a bending-resistant, bendable retaining member, and a functional device attached to the retaining member. Retaining member being bendable and held in a bent position without a restoring force, and is connected to signal interface for positioning functional device. Electrical signal lines are provided in retaining member, and running between signal interface and functional device. There is a fixing element which can be placed on retaining member in various longitudinal positions to secure retaining member. A retaining clip, which can be bent into position, extends between signal interface and fixing element. A rear section of retaining member, the signal interface, the retaining clip, and the fixing element form a loop, and the size of the loop is adjustable and changeable by displacing fixing element along retaining member, in use, and loop being configured for receiving an auricle of a user and running at least partially behind auricle, is use.

The invention is based on the idea of achieving fastening by a loop placed around the outer ear or the auricle, including the earlobe, the loop being reliably adjustable in size by a fixing element. For this purpose, a retaining member extends from a signal interface under the auricle to the front and at the end carries the functional device to be positioned, namely the microphone, in particular.

According to the invention, the retaining clip extends from the fixing element to the back and upward, is placed over the auricle, and on the front, together with the fixing element, receives the retaining member, for example at an acute angle, namely an angle smaller than a right angle, or also at a substantially right angle.

The signal interface may be a control device, which receives, processes (for example amplifies) and forwards signals. For this purpose, the control device can be provided, for example, behind the auricle (which is to say completely or partially covered by the auricle) or also combined with the fixing element. The forwarding process can take place via an output line and/or via wireless signals.

Furthermore, the signal interface may serve only for routing the internal signal lines to the output lines. It is preferred if a powerful amplifier is provided in the microphone and if the signal lines are shielded from induction, for example as coaxial cables or twisted pair lines. For this, a combination of the signal interface with the fixing element is advantageous.

The fixing element can be particularly a clamping element, which receives the retaining member, for example, in a through-hole or an eye. Furthermore, different fixing actions are possible, for example in a form-fit manner or by means of a securing member, such as a screw or a pin.

According to the invention, a loop is formed in general by the rear section of the retaining member, the control device and the retaining clip to the clamping device. The length of the rear section of the retaining member included in the loop changes as the size of the loop is adjusted, and in the case of a large loop setting may disappear entirely, so that the loop is then formed solely by the retaining clip and the fixing element, optionally also by the signal interface. The loop has a certain amount of outwardly directed residual bias and therefore has no constricting effect. Advantageously, the loop forms an oval shape with a tip on the fixing element and as a result receives the auricle in an anatomically advantageous manner. The angle on the fixing element is advantageously acute, namely smaller than a right angle, so as to achieve a good tensioning or clamping effect, or also for example a right angle. Surprisingly, this configuration is self-correcting and self-centering.

According to the invention, it has been recognized that the elastic retaining clip, which is placed on top over the auricle, on the front extends downward and is rigid (which is to say it maintains a certain level of inherent rigidity in the bent positions and does not slacken), is subject to bending stress, which pulls the fixing element away to the front and upward. The fixing element can thus be configured as a simple eye, which the user can displace arbitrarily (i.e., in any desired manner) on the retaining member in the longitudinal direction with little effort, wherein due to the bending stress of the retaining clip tilting of the eye is achieved—without further locking elements—and the longitudinal position is secured. During the manual adjustment, the user will generally use one hand to grasp the retaining member in front of the fixing element and the other hand to grasp the retaining clip above the fixing element and displace it in the longitudinal direction, wherein the required force can also be applied by weaker persons.

A clamping action can already be achieved by a slight difference between the inside diameter of the eye and the outside diameter of the retaining member. The diameters may substantially correspond to each other such that displacement is possible due to the elasticity of the outer casing of the retaining member and the above-mentioned tilting brings about an additional securing effect. Furthermore, the control device may be a sliding stop against slippage of the clamping element toward the back, whereby a constriction of the auricle with grossly negligent adjustments is prevented.

According to a preferred embodiment, one or more individual wires run in the retaining member and the retaining clip, the wires being twisted or not twisted. Individual wires of this type with a surrounding outer casing enable a dimensionally stable adjustment with a certain level of elasticity and without requiring a restoring force when the elasticity is overcome. According to the invention, the one or more individual wires of the retaining member and retaining clip may be configured to be continuous, which is to say they extend from the functional device to the fixing element, wherein they can run in or next to the signal interface. As a result, the retaining member and the retaining clip may transition into one another according to the invention. They may also be configured as one piece; an embodiment of this type is particularly advantageous when combining or integrating the fixing element and signal interface, thus allowing a continuous clip to extend from the functional device to the signal interface. In the signal interface, the signal lines can, for example, be routed through, for example to a downwardly extending line.

When configuring the one or more individual wires through the retaining member and the retaining clip to be continuous, uniform rigidity and elasticity of the loop are guaranteed. It has been shown that precisely this configuration enables fastening that is secured against slippage and is perceived comfortable, non-interfering and non-constricting by the user.

The electrical lines running between the functional device and the signal interface can advantageously be received between the (for example twisted) individual wires of the retaining member. Additionally, a rounder shape of the bundle of individual wires and electrical lines is achieved, so that subsequently a uniform round shape is achieved after molding a thin outer casing made of plastic or rubber around, the shape being received without substantial clearance by an eye with a round cross-section.

The headset according to the invention does not block the auditory canal; since it is not attached in the auricle or outer ear, it is hygienically safe. Since it has no preferred left or right direction, it can be used equally for the left and right ear.

Alternatively to the configuration with rigid individual wires, the retaining member and/or the retaining clip can also be formed, for example, as injection molded parts, or the retaining member by molding material around the signal lines.

Relative terms such as left, right, up, and down are for convenience only and are not intended to be limiting.

The invention will be explained in more detail hereinafter with reference to the several embodiments that are schematically illustrated in the attached figures.

DETAILED DESCRIPTION OF THE INVENTION

Figure 1:
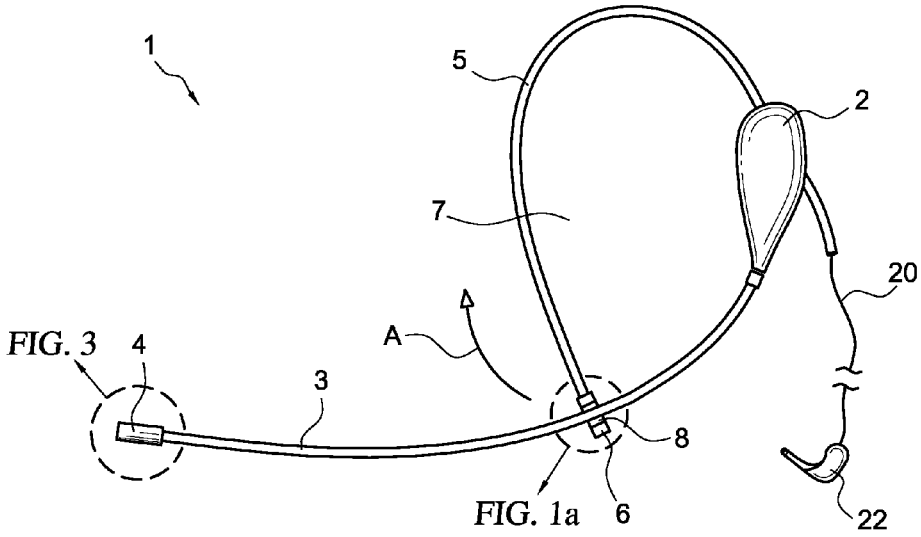
FIG. 1 is a side view of an inventive headset according to a first embodiment.

A headset 1 according to the embodiment of FIGS. 1 to 4 includes a control device 2, which in the illustrated embodiment acts particularly as an impedance transformer, a forwardly directed, elongated, rigid retaining member 3 extending from the control device, and the retaining member can be bent and held in the bent position without a restoring force; i.e., the rigid retaining member is bending-resistant, yet bendable. There is a microphone 4 serving as the functional device, and a retaining clip 5 extending from the control device 2, and a securing or fixing element 6 is fastened to the end of the clip opposite from the control device 2. Retaining clip 5 may be a bending-resistant, flexible retaining clip. The microphone 4 and the control device 2 are disposed on opposing ends of the retaining member 3; the fixing device 6 is mounted longitudinally displaceably on the retaining member 3 and can be adjusted with respect to the respective longitudinal positions along the retaining member 3 between the microphone 4 and the control device 2 while providing a fixing effect, e.g., developing a securing force. The fixing effect according to the embodiment from FIG. 1 and/or FIG. 1*a* can be, for example, a clamping force, so that the fixing element is a clamping element 6; alternatively, however, also a different fixing action may occur, for example by a form fit or by an inserted securing element, for example an inserted screw or the like. The fixing action is advantageously detachable and reversible, allowing subsequent adjustment. The rear section of the retaining member 3, the control device and the retaining clip 5 with the clamping device 6 therefore form a closed loop 7, the size thereof being continuously adjustable by the fixing element 6.

When configuring the fixing element 6 as a clamping element 6, the element is advantageously configured, for example, as a cylindrical, metallic body with an eye 8, the body being placed on the end of the retaining clip 5, and the retaining member 3 being inserted through the eye. The eye 8 has an inside diameter, which substantially corresponds to the outside diameter of the retaining member 3. As a result, a sliding displacement of the clamping element 6 with the eye 8 thereof on the retaining member 3 is possible, while maintaining a frictional engagement in the respective longitudinal positions.

The retaining member 3 and the retaining clip 5 are advantageously formed by twisted individual wires 10, a plastic casing 12 being molded around them. Additionally, in the retaining member 3 insulated electrical lines 14 are routed between the individual wires 10. Furthermore, according to FIG. 4, an individual wire 10 may be the middle, neutral phase, around which the three further individual wires 10 and the three electrical lines 14 are twisted. The individual wires 10 can also be used as an electrical line.

According to a preferred embodiment, the individual wires 10 of the retaining member 3 are further routed as individual wires 10 of the retaining clip 5 such that they extend from the microphone 4 to the clamping element 6; here, the control device 2 is inserted in a de-insulated (e.g., stripped) region and connected to the electrical lines 14 extending from the microphone.

For production, thus individual wires 10 can be twisted, the control unit 2 with the electrical lines 14 can be placed on a center region, and the electrical lines 14 can be routed between the twisted individual wires to the front end; thereafter, the plastic outer casing 12 is molded on, wherein a central region is omitted or subsequently bared for the control device 2, and end regions are omitted or subsequently bared for the microphone 4 and the clamping element 6. At the center, the control device 2 is installed; the lines 14 extend from the device as electrical connecting lines 20 and are connected to a plug contact 22; on the rear end, the clamping element 6 is attached to the individual wires 10 and pushed on the retaining member 3; at the front end, the microphone 4 is attached to the individual wires 10 and connected to the electrical lines 14. The single-piece or multiple-piece control device 2 can thus serve particularly for the reception, amplification and forwarding of the acoustic signals via the connecting line 20.

Figure 1A:
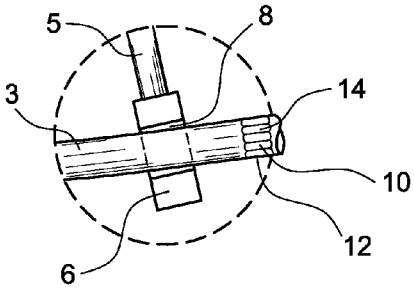
FIG. 1*a* is a detailed enlargement of the clamping element according to FIG. 1.

According to the detailed enlargement of FIG. 1*a*, as a result of the bending stress particularly of the retaining clip 5 a tilting effect of the clamping element 6 with the eye 8 thereof on the retaining member 3 is brought about, since according to the arrow A in FIG. 1 the retaining clip 5 swivels the clamping element forward and upward, thus effecting a tilting of the eye 8 on the retaining member 3. This clamping effect prevents autonomous tightening of the loop 7.

Figure 2:
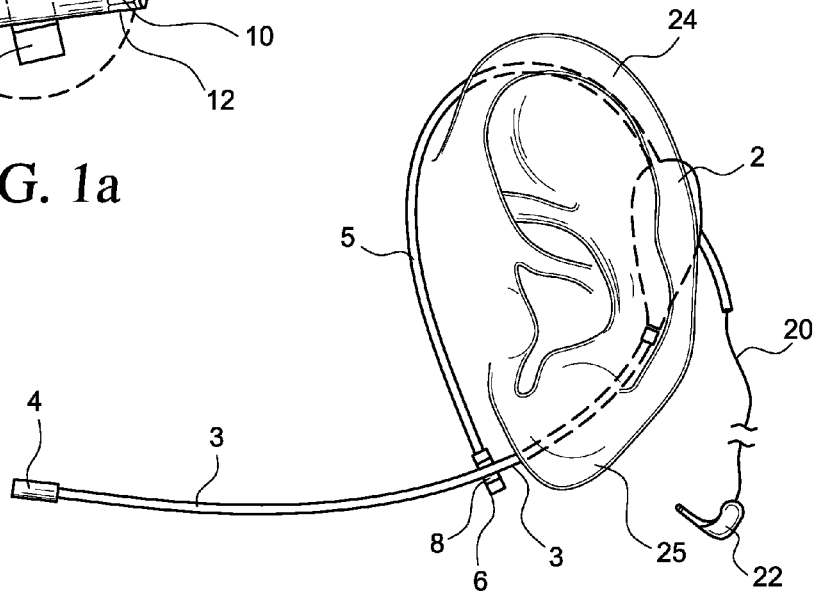
FIG. 2 is the attachment of the headset according to FIG. 1 on the auricle of a user.

FIG. 2 shows the attachment of the inventive headset 1 to an auricle 24 of a user. For the attachment, the clamping element 6 may optionally first be placed in a forward position on the retaining member 3, which is say closer to the microphone 4. The adjustment is performed such that the loop 7 is sufficiently large to be placed over the auricle 24 without requiring the user to bend the auricle 24 forward and force it into the loop 7. The loop 7 is placed around the auricle 24 such that the control device 2 is located behind the auricle 24, preferably hidden by the same, the retaining member 3 is located beneath the concha and advantageously extends under the earlobe 25 and protrudes forward with the front end with the microphone 4. Starting behind the auricle 24, the retaining member 5 first extends from the control device 2 upward, then continues forward over the auricle 24, from there downward to the clamping element 6 such that the retaining clip 5 with the clamping element 6 meets the retaining member at a substantially right angle. Subsequently, by displacing the clamping element 6, the user can adjust a suitable position in which the loop 7 provides secure retention and can additionally orient the microphone in a suitable position by bending the retaining member 3.

This attachment and orientation is performed the same on either of the user's side, which is to say for the left or right auricle 24. The plug 22 of the electrical line 20 can be inserted, for example, in a device attached to the user's belt.

Advantageously, the retaining member 3 and the retaining clip 5 have substantially equal rigidity or elasticity, resulting in a substantially equivalent curvature of these regions during the adjustment to the auricle 24; it is preferable if a substantially oval shape of the loop 7 is formed with an acute angle between the clamping element 6 and retaining member 3. Instead of the microphone 4, also a hearing aid, for example, or a cochlea transmitter, for example, or an external receiver, for example, may be provided as the functional device, wherein in such embodiments the retaining member 3 is shaped accordingly different for the positioning of the respective functional device.

Figure 3:
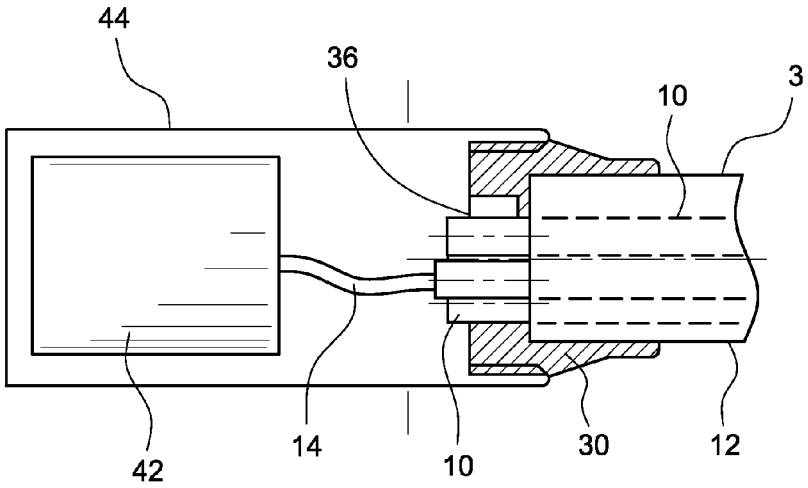
FIG. 3 is a partial view of a detail III of FIG. 1, on an enlarged scale.
Figure 4:
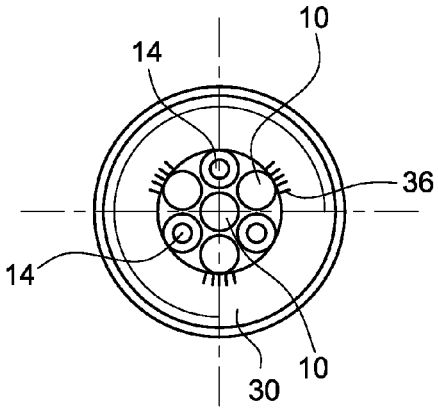
FIG. 4 is a radial section IV-IV through the functional device according to FIGS. 1 to 3 with a view of the application area of the retaining wire/bending element on the functional device.

FIGS. 3 and 4 show the connection of the microphone 4 and/or the clamping element 6 to the retaining member 3 or the retaining clip 5. The individual wires 10 and electrical lines 14 have been bared and inserted in a metal bushing 30; by means of laser welding, laser-weld connections 36 are established between the outer circumference of one or more individual wires 10 and the metal bushing 30; also, an adhesive may be added. The electrical lines 14 are connected to an electrical functional part 42 in the microphone 4, wherein, for example, one contact can be made via an electrical line 14 and another contact via a housing 44 receiving the functional device 42, the housing being fastened to the bushing 30, for example screwed on by use of a screw thread. Alternatively, a connection via a plurality of lines is possible.

The connection by laser weld points enables a cost-effective, fast and very durable connection in relation to the sometimes extremely high forces and bending torque occurring when bending the microphone 4.

Figure 5:
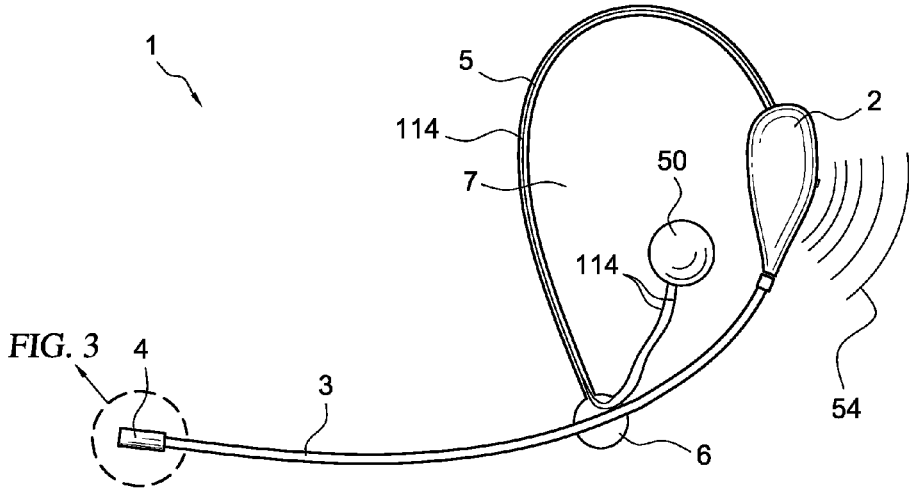
FIG. 5 is a side view of an inventive headset according to a further embodiment.
Figure 6:
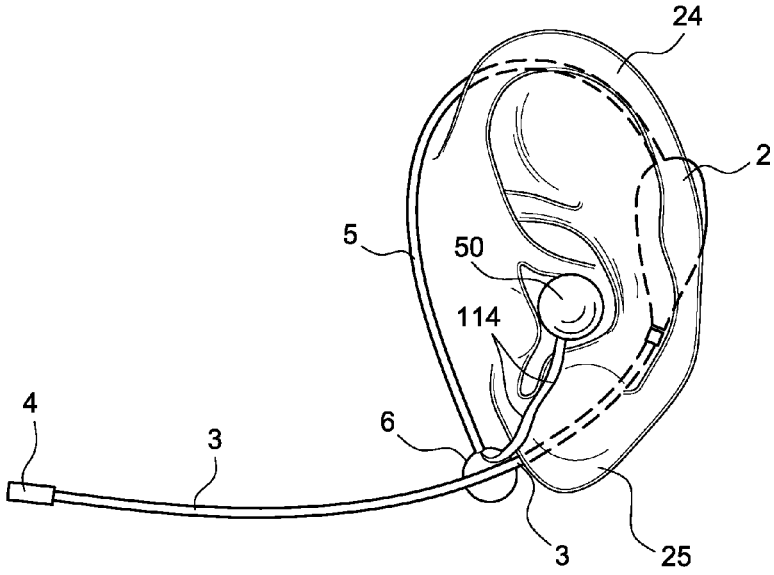
FIG. 6 is the attachment of the headset according to FIG. 5 on the auricle of a user.

FIG. 5 shows a further embodiment, wherein in an otherwise identical construction at least one electrical line 114, preferably at least two electrical lines 114 are routed from the control device 2 in the retaining clip 5 to the fixing element 6 and from there to an earpiece (or speaker) 50, which according to FIG. 6 can be positioned in the auricle 24. The earpiece 50 can be configured, for example, in accordance with the functional device 42 from FIG. 3 and fed or powered via the lines 114.

The lines 114 here can be routed out of the retaining clip 5 in the fixing element 6 or also in front of the same and from there the lines run to the concha of the auricle 24. The earpiece 50 may be provided in the concha or also in the auditory canal of the auricle 24.

Alternatively to the illustrated embodiments, however, it is also possible to route the electrical lines 114 from the control device 2 directly to the earpiece 50 or partially along the retaining member 3 and from there to the earpiece 50.

Furthermore, according to FIGS. 5 and 6 the functional device 2 or a further device may also serve as a transmitter and/or receiver for wireless signals 54, for example Bluetooth® signals 54 (Bluetooth® is a Registered Trademark of Bluetooth Sig, Inc., Bellevue Wash. 98004, USA). Such a configuration of the control device 2 or the addition of a corresponding device for transmitting and/or receiving purposes can in principle also be implemented in the embodiment according to FIGS. 1 to 4 (instead of the connecting line 20). The wireless signals 54 can be used to forward the signals received by the functional device 4 and/or to receive wireless signals and forward them to the earpiece 50.

The transceiver device can in principle also be provided in a location that differs from the control device in the headset, for example in the fixing element 6.

Also in the embodiment according to FIGS. 5, 6 with the earpiece 50, in principle data communication can be performed via a single- or multiple-core connecting line 20 in accordance with FIGS. 1 to 4. The illustrated embodiments can therefore be combined.

Figure 7:
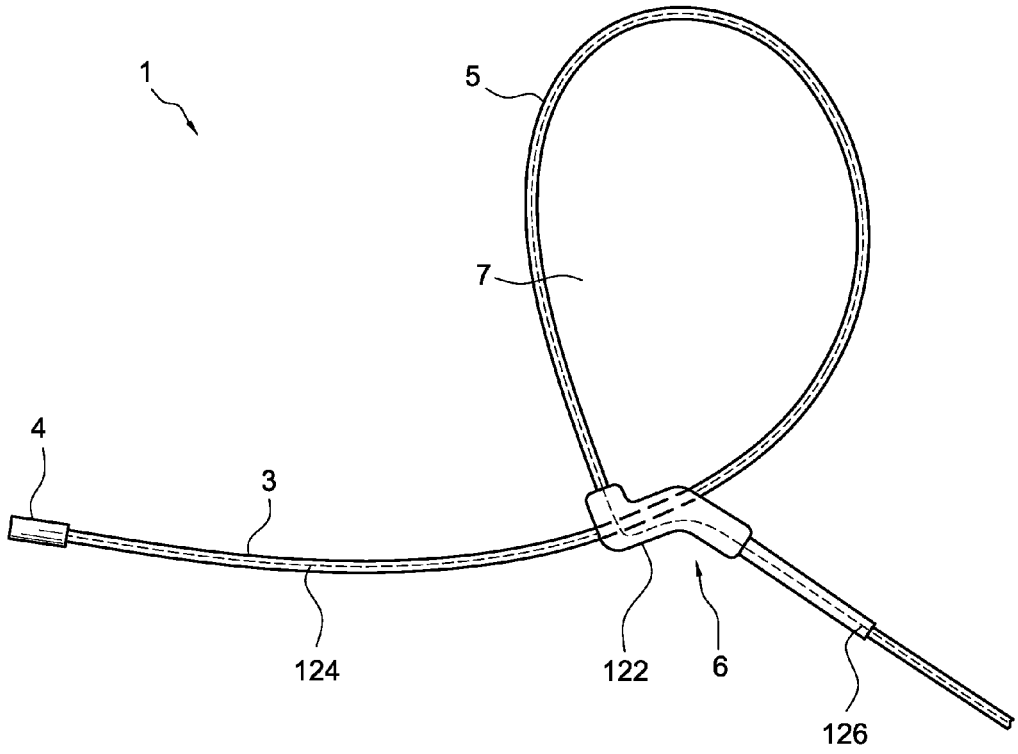
FIG. 7 is a side view of an inventive headset according to a further embodiment.

FIG. 7 shows a further embodiment, wherein the signal interface 122 is combined with the clamping element 6. Hence, the retaining member 3 and the retaining clip 5 may transition into one another and particularly can also be configured as one piece as a common clip 3, 5. The electrical lines 124 again extend from the microphone 4 and run through the retaining member 3 and from there through the connecting retaining clip 5 to the signal interface 122. The signal interface 122 here, according to the illustrated embodiment, may route the electrical lines 124 directly as output lines 126 or may connect the electrical lines to the output lines 126. In such an embodiment, advantageously a powerful amplifier is integrated in the microphone 4 and the lines 124 are shielded from induction, for example as coaxial cables or twisted pair cables. The signal interface 122 may be shaped, as is illustrated, in an arched manner or may be S-shaped and thus direct the output lines 126 away in a slightly offset manner, or it may also enable straight routing of the lines 124 without any offset.

Alternatively, in FIG. 7 the signal interface 122 can again receive and amplify (and optionally further process) the signals of the lines 124 and forward them to the output lines 126. In this embodiment, for example, a small circuit board is integrated in the signal interface/control device 122.

This embodiment according to FIG. 7 may also be modified in that in accordance with FIG. 5 the signal interface/control device 122 is used to transmit wireless signals 54.

In principle, any arbitrary data communication from the headset 1 to external devices is possible. In addition to the medical field for hearing aids, also use in other applications is possible, for example voice input and voice output in the field of entertainment media or for telephone hotlines, for example call centers, as a hands-free device in motor vehicles, during television broadcasts or the like.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A headset, comprising:

a) a signal interface configured for receiving and forwarding electrical signals;

b) a bending-resistant, bendable retaining member;

c) a functional device attached to the retaining member;

d) the bending-resistant, bendable member configured for being bent and held in a bent position without a restoring force, and which is connected to the signal interface for positioning the functional device which is attached to the rigid retaining member;

e) electrical signal lines provided in the retaining member, and that run between the signal interface and the functional device;

f) a fixing element which can be placed on the retaining member in various longitudinal positions to secure the retaining member;

g) a bending-resistant, flexible retaining clip, which can be bent into position and extends between the signal interface and the fixing element, and the retaining clip being configured as a dimensionally stable wire clip that can be bent and that includes at least one individual wire; and h) a rear section of the retaining member, the signal interface, the retaining clip, the fixing element form a loop, the size of the loop being adjustable and changeable by displacing the fixing element along the retaining member, the loop being configured for receiving an auricle of a user and running at least partially behind the auricle of the user.

2. The headset according to claim 1, wherein:

a) the fixing element is disposed between the functional device and the signal interface.

3. The headset according to claim 1, wherein:

a) when attached to the auricle, the signal interface runs behind the auricle, and the retaining clip extends starting from the signal interface behind the auricle upward over the auricle forward and in front of the auricle downward, and the retaining member extends starting from the signal interface behind the auricle and under an earlobe of a user forward.

4. A headset according to claim 1, wherein:

a) at least one electrical output line extends from the signal interface.

5. A headset according to claim 1, wherein:

a) the retaining clip and the retaining member have substantially the same elasticity.

6. A headset according to claim 1, wherein:

a) the retaining clip and the retaining member are configured as continuous clips.

7. A headset according to claim 1, wherein:

a) the retaining member is configured as a dimensionally stable wire member that can be bent and that includes at least one individual wire.

8. The headset according to claim 7, wherein:

a) the at least one individual wire runs continuously through the retaining member and the retaining clip and is one of received in and adjacent to the signal interface.

9. A headset according to claim 1, wherein:

a) the at least one individual wire is fastened to one of the functional device and the fixing element by laser welding.

10. A headset according to claim 1, wherein:

a) one of the retaining member and the retaining clip is made of one of a rigid plastic and rubber material which can be bent into position.

11. A headset according to claim 1, wherein:

a) one of the retaining member and the outer casing thereof is made of a material for frictionally engaging the fixing element in continuously adjustable longitudinal positions.

12. A headset according to claim 1, wherein:

a) the fixing element is a clamping element.

13. The headset according to claim 12, wherein:

a) the clamping element clamps on the retaining member with a clamping force that can be overcome manually.

14. The headset according to claim 12, wherein:

a) the clamping element includes an eye through which the retaining member extends while applying the clamping force.

15. A headset according to claim 1, wherein:

a) the fixing element can be fixed in place in a form-fit manner.

16. A headset according to claim 1, wherein:

a) the signal interface is configured as one of a single-piece and a multiple-piece control device; and b) the headset includes an earpiece for receiving electrical signals and for transmitting sound signals into an auricle or auditory canal of the user, the earpiece being connected to the control device via electrical lines.

17. The headset according to claim 16, wherein:

a) the electrical lines run in the retaining clip to the earpiece.

18. The headset according to claim 17, wherein:

a) the electrical lines run in the retaining clip to the fixing element.

19. A headset according to claim 1, wherein:

a) the signal interface is configured as one of a single-piece and a multiple-piece control device for one of forwarding and receiving signals via one of a connecting line and wireless signals.

20. A headset according to claim 1, wherein:

a) the signal interface one of connects the internal electrical signal lines with external output lines and routes the internal signal lines out as external output lines.

21. A headset according to claim 1, wherein:

a) the signal interface is configured as one of integrated in and combined with the fixing element.

22. A headset, comprising:

a) a signal interface configured for receiving and forwarding electrical signals;

b) a bending-resistant, bendable retaining member;

c) a functional device attached to the retaining member;

d) the bending-resistant, bendable member configured for being bent and held in a bent position without a restoring force, and which is connected to the signal interface for positioning the functional device which is attached to the rigid retaining member;

e) electrical signal lines provided in the retaining member, and that run between the signal interface and the functional device;

f) a fixing element which can be placed on the retaining member in various longitudinal positions to secure the retaining member;

g) a bending-resistant, flexible retaining clip, which can be bent into position and extends between the signal interface and the fixing element, and the retaining clip being configured as a dimensionally stable wire clip that can be bent and that includes at least one individual wire;

h) one of the retaining member and the retaining clip includes a plurality of twisted individual wires and an outer casing surrounding them; and i) a rear section of the retaining member, the signal interface, the retaining clip, the fixing element form a loop, the size of the loop being adjustable and changeable by displacing the fixing element along the retaining member, the loop being configured for receiving an auricle of a user and running at least partially behind the auricle of the user.

23. The headset according to claim 22, wherein:

a) the fixing element is disposed between the functional device and the signal interface.

24. A headset, comprising:

a) a signal interface configured for receiving and forwarding electrical signals;

b) a bending-resistant, bendable retaining member;

c) a functional device attached to the retaining member;

d) the bending-resistant, bendable member configured for being bent and held in a bent position without a restoring force, and which is connected to the signal interface for positioning the functional device which is attached to the rigid retaining member;

e) electrical signal lines provided in the retaining member, and that run between the signal interface and the functional device;

f) a fixing element which can be placed on the retaining member in various longitudinal positions to secure the retaining member;

g) a bending-resistant, flexible retaining clip, which can be bent into position and extends between the signal interface and the fixing element;

h) a rear section of the retaining member, the signal interface, the retaining clip, the fixing element form a loop, the size of the loop being adjustable and changeable by displacing the fixing element along the retaining member, the loop being configured for receiving an auricle of a user and running at least partially behind the auricle of the user;

i) the fixing element being a clamping element;

j) the clamping element including an eye through which the retaining member extends while applying the clamping force; and k) the clamping element with the eye being tilted on the retaining member under the effect of a bending torque applied by the retaining clip.

* * * * *